United States Patent [19]

Wen-tsung

[11] Patent Number: 4,974,135

[45] Date of Patent: Nov. 27, 1990

[54] STRUCTURE OF ADJUSTABLE DESK LAMP

[76] Inventor: Chen Wen-tsung, 4F, No. 289, Chung Chen S Rd., Sanchung City, Taipei Hsien, Taiwan

[21] Appl. No.: 503,581

[22] Filed: Apr. 3, 1990

[51] Int. Cl.[5] ..... F21S 1/12; F21S 3/12

[52] U.S. Cl. ..... 362/287; 362/401; 362/413; 362/427

[58] Field of Search ..... 362/285, 287, 391, 401, 362/410, 413, 418, 419, 422, 426, 427

[56] References Cited

U.S. PATENT DOCUMENTS

| | | | |
|---|---|---|---|
| 3,790,773 | 2/1974 | Sapper | 362/426 |
| 4,772,991 | 9/1988 | Wood | 362/427 |
| 4,858,092 | 8/1989 | Lu | 362/413 |
| 4,892,278 | 1/1990 | Huang | 362/427 |

FOREIGN PATENT DOCUMENTS

| | | | |
|---|---|---|---|
| 686483 | 1/1953 | United Kingdom | 362/413 |

OTHER PUBLICATIONS

Follow the Leader in Halogen Lighting, Kenroy International Advertisement.

*Primary Examiner*—Ira S. Lazarus
*Assistant Examiner*—Richard R. Cole
*Attorney, Agent, or Firm*—Lowe, Price, LeBlanc, Becker & Shur

[57] ABSTRACT

A desk lamp, which includes a lamp shade structure comprised of a lamp shade, a sleeve set in the lamp shade, an adjusting rod having a thread portion on its upper end, and a lamp socket; a lamp bracket being to secure the lamp shade structure to a lamp stand and comprised of two parallel rods and upper, intermediate and lower union swivels; and a pendulum having stepped holes therethrough for the setting therein of screw rod, insulator ring and tubes, and lock nuts. Through the control of the sleeve, the lamp shade is allowed to rotate on the lamp bracket. Through the arrangement of the union swivels, the two parallel rods of the lamp bracket form to separate conductive circuits for conducting electricity. Through the lower union swivel, the lamp bracket is permitted to rotate on the lamp stand.

1 Claim, 6 Drawing Sheets

STRUCTURE OF ADJUSTABLE DESK LAMP

BACKGROUND AND SUMMARY OF THE INVENTION

The present invention is related to desk lamps and more particularly to a desk lamp in which the angular position of the lamp shade as well as the lamp bracket can be conveniently adjusted.

In the variety of conventional desk lamps, the projecting angle of a lamp is generally adjusted by means of connecting rods, i.e., the change of angular position of a lamp is confined to the moving range of the associated connecting rods.

The present invention is to provide such a type of desk lamp, in which the lamp shade and the lamp bulb can be conveniently replaced. A desk lamp in accordance with the present invention is generally comprised of an adjustable lamp shade structure, an adjustable lamp bracket structure, a pendulum and a lamp stand. Through the control of an adjusting rod, the lamp shade of the desk lamp can be rotated axially through an angle of 360° so as to change the angle of projection. As soon as the adjusting rod is removed from the lamp shade structure, the lamp shade and lamp bulb can be conveniently replaced. The lamp bracket structure is generally comprised of two parallel rods incorporated with upper, intermediate and lower union swivels. Through the arrangement of lock nuts, screw rods and connectors in the union swivels, the two parallel rods form to independent circuits insulated against short circuit from each other. The pendulum is comprised of two opposite parts having therein stepped holes insulated with insulator ring and tubes and incorporated with screw rod and lock nuts to form a circuit breaker.

BRIEF DESCRIPTION OF THE DRAWINGS

The present invention will now be described by way of example, with reference made to the annexed drawings, in which.

DETAILED DESCRIPTION OF THE PREFERRED EMBODIMENTS

Figure 1:
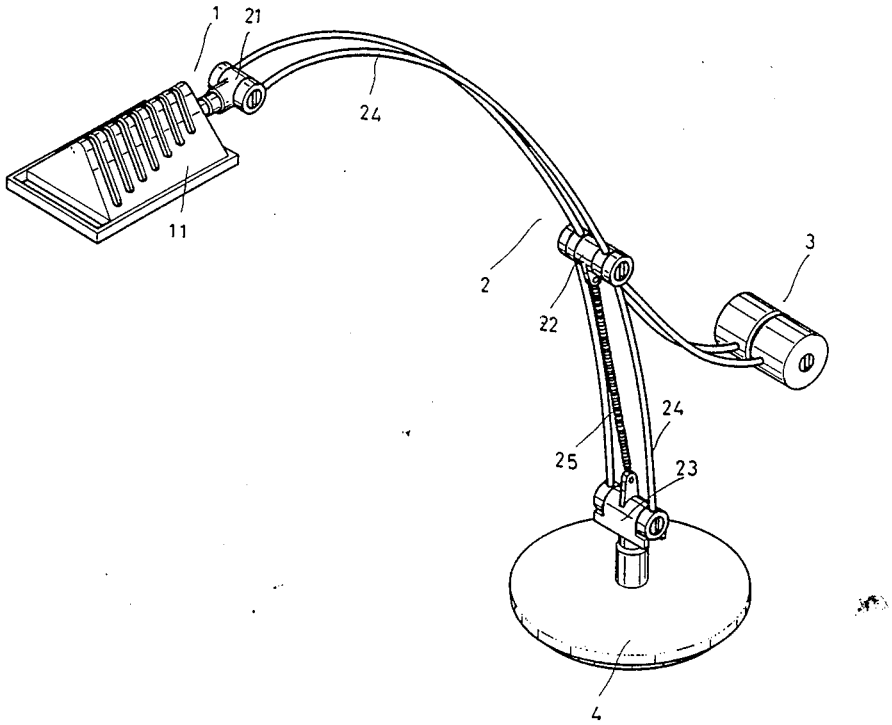
FIG. 1 is a perspective view of a desk lamp in accordamce with the present invention.
Figure 2:
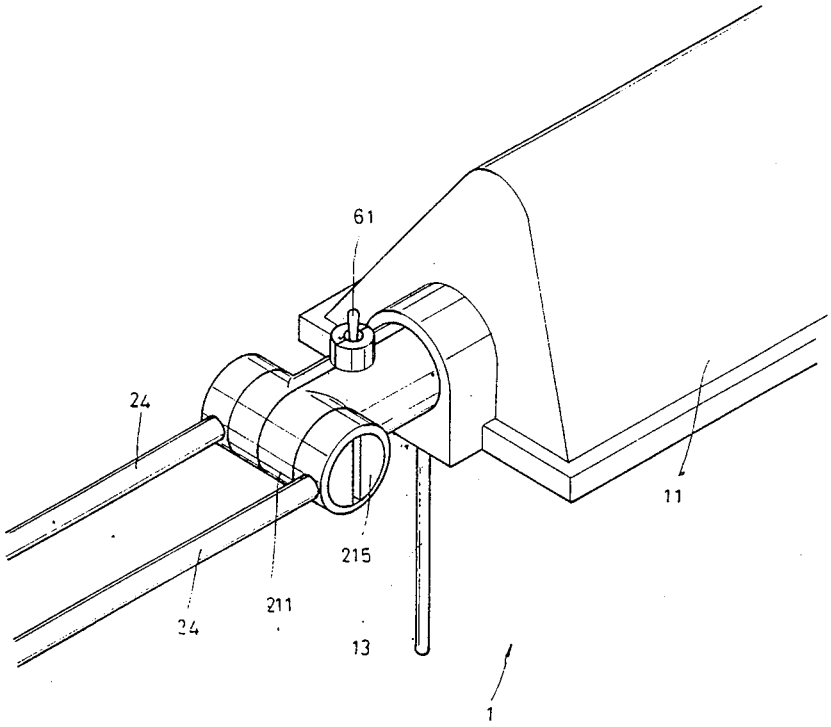
FIG. 2 is a partly perspective view of the desk lamp of FIG. 1, illustrating the connection of the lamp shade with the upper union swivel.
Figure 3:
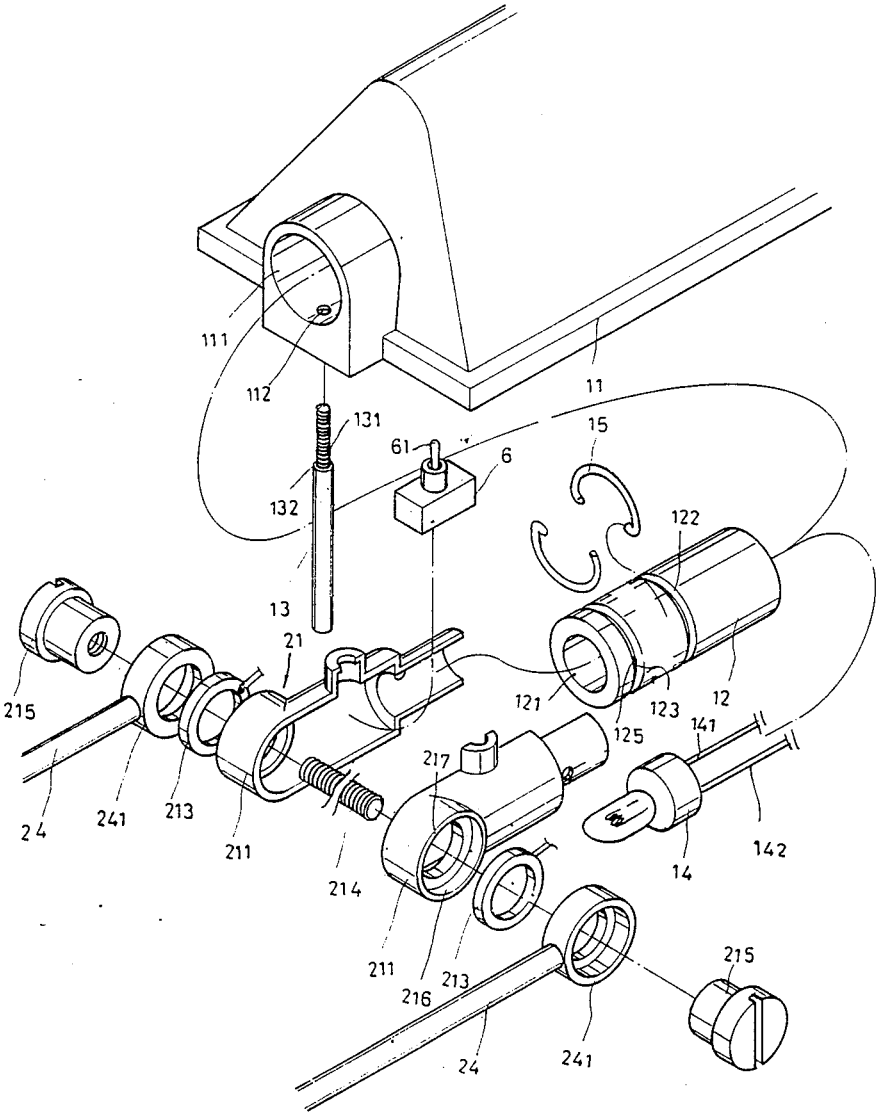
FIG. 3 is a perspective exploded view of the lamp shade and the upper union swivel.
Figure 4:
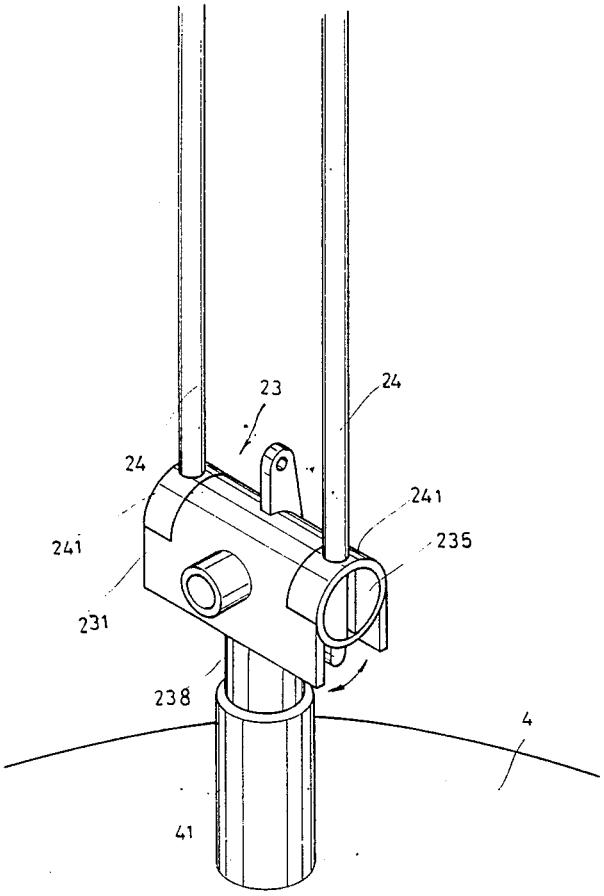
FIG. 4 is a partly perspective view of the desk lamp of FIG. 1, illustrating the connection of the lower union swivel with the stand.
Figure 5:
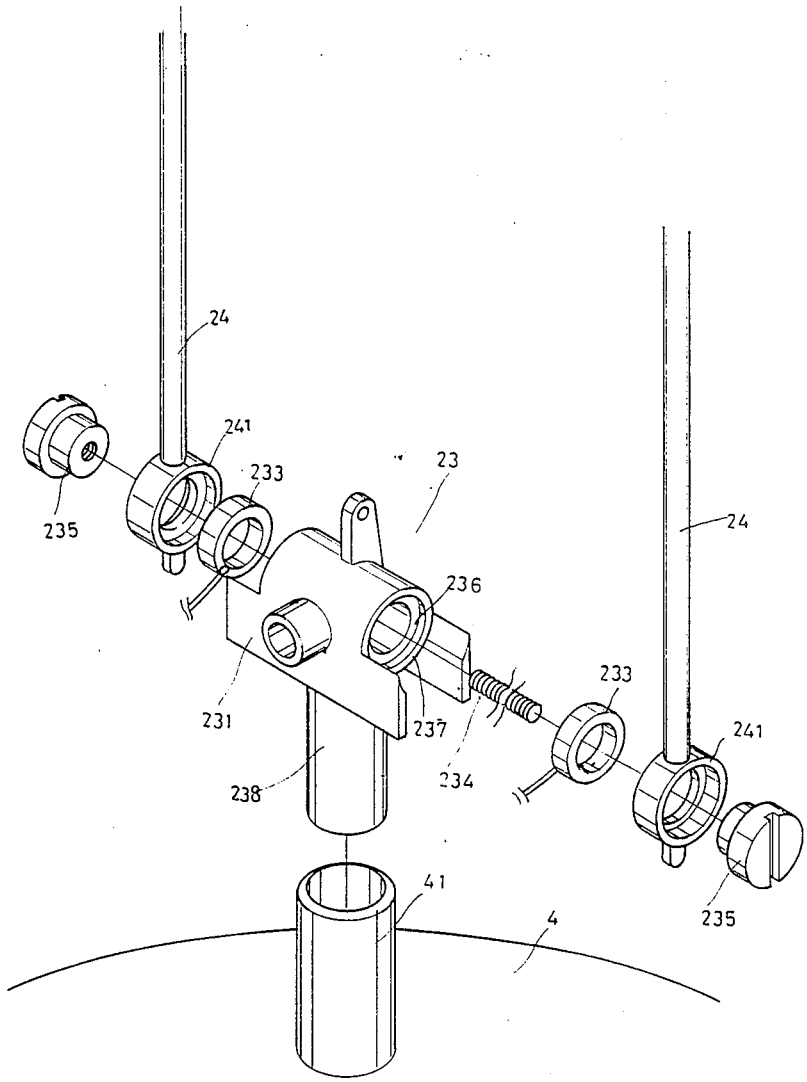
FIG. 5 is a perspective exploded view of the lower union swivel and the stand.
Figure 6:
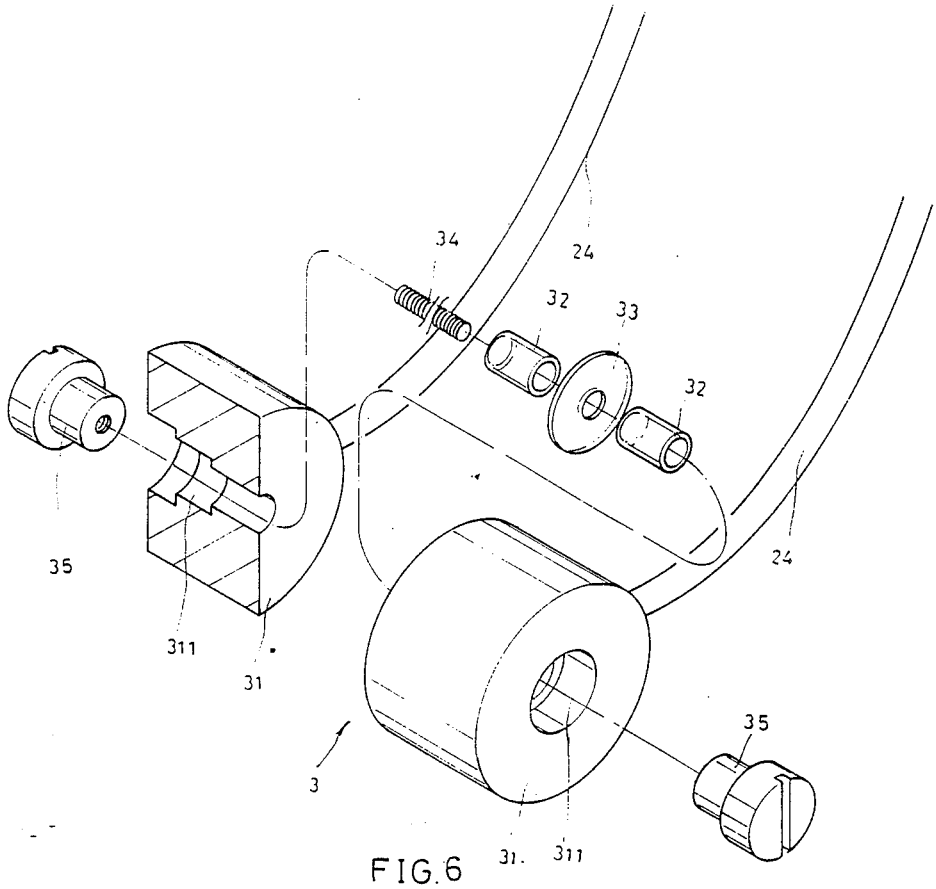
FIG. 6 is a perspective fragmentary view of the pendulum.

Turning now to the annexed drawings in greater detail, therein illustrated is a desk lamp in accordance with the present invention and generally comprised of an adjustable lamp shade structure (1), an adjustable lamp bracket structure (2), a pendulum (3), and a lamp stand (4).

The lamp shade structure (1) is comprised of a lamp shade (11), a sleeve (12), an adjusting rod (13) and a lamp socket (14). The lamp shade (11) comprises transversely an axle hole (111) having a bolt hole (112) vertically through its inner wall surface at a lower position.

The sleeve (12) comprises a boring bore (121) for receiving the lamp socket (14); a first circular groove (122) for the setting therein of the top thread portion (131) of the adjusting rod (13), when the adjusting rod (13) is fastened in the bolt hole (112), to secure the positioning of the sleeve (12) in the lamp shade (11); and a second circular groove (123) having two small holes (125) therethrough. The adjusting rod (13) has a stepped portion (132) to control the range of the top thread portion (131) in the first circular groove (122) of the sleeve (12) permitting the lamp shade (11) to rotate axially through an angle of 360°.

The lamp bracket structure (2) is comprised of an upper union swivel (21), an intermediate union swivel (22), a lower union swivel (23), two parallel rods (24), and an expansion spring (25). The upper union swivel (21) is comprised of a connector (211), two conductive rings (213), two retaining rings (241) which are respectively mounted on the top end of the two parallel rods (24), a screw rod (214), and a pair of lock nuts (215). During assembly, the sleeve (12) is inserted in the connector (211) permitting the small holes (125) to be aimed at the small holes (212) of the connector (211) so that two C-shaped retainers (5) can be inserted to secure the sleeve (12) to the upper union swivel (21). The connector (211) is formed of two half parts, permitting the two cables (141) and (142) from the lamp socket (14) to insert therein for connection to the two conductive rings (213). A switch (6) is received in the connector (211) with its shifting lever (61) exposed outside. The two conductive rings (213) are bilaterally set in the two opposite, recessed portions (216) of the two half parts of the connector (21) and partly protruding beyond the bilateral edge (217) thereof so as to respectively contact the two retaining rings (241) of the two parallel rods (4). The screw rod (214) is transversely set in the retaining rings (241), the conductive rings (213) and the connector (211), with its both ends respectively screwed up with the two lock nuts (215). Because the screw rod (214) is suspended in the two conductive rings (213), the connector (211) and the two retaining rings (241), the two conductive rings (213) are constantly protected from electric contact to prevent against short circuit. The intermediate union swivel (22) has a structure similar to the upper union swivel (21), permitting the transmission of electricity through the two parallel rods (24). The lower union swivel (23) has a structure similar to the upper union swivel. The only difference between the upper union swivel (21) and the lower union swivel (23) is the shape of the two connectors (211) and (231) thereof. The expansion spring (25) is set between the connector (231) of the lower union swivel (23) and the intermediate union swivel (22). The connector (231) of the lower union swivel (23) has a bottom shaft (238) inserted in an unitary sleeve (41) which extends upward from the stand (4) so that the lower union swivel (23) is allowed to rotate horizontally through an angle of 360° relative to the stand (4).

The pendulum (3) is backwardly connected to the intermediate union swivel (22) through two branch rods, and comprised of two circular weights (31), two insulator tubes (32), an insulator ring (33), a screw rod (34) and two lock nuts (35). The two circular weights (31) comprise each a stepped hole (311) through its central axis for the setting therein of the two insulator tubes (32) respectively, with the insulator ring (33) set in therebetween to protect the two circular weights (31)

from contact with each other. The screw rod (34) is inserted through the insulator ring (33), the two insulator tubes (32) and the two stepped holes (311) of the two circular weights (31), with its both ends respectively screwed up with the two lock nuts (35). Therefore, through the suspended screw rod (34), the insulator ring (33) and the two insulator tubes (32), the two circular weights (31) are insulated from each other.

As described above, the lamp stand (4) comprises an unitary, upstanding sleeve (41) into which the bottom shaft (238) of the lower union swivel (23) of the lamp bracket structure (2) is revolvably fastened.

As soon as the whole assembly of the present invention is set up, the lamp shade (11) of the lamp shade structure (1) can be axially rotated through an angle of 360° by means of the control of the adjusting rod (13) so as to adjust the angle of projection. When the adjusting rod (13) is loosened to separate its thread portion (131) from the first circular groove (122) of the sleeve (12), the lamp shade (11) can be removed for replacement with another one. By means of mounting or removing the C-shaped retainers (5), the sleeve (12) can be conveniently fastened in or released from the connector of the upper union swivel (21). By means of the arrangement of the upper, intermediate and lower union swivels (21), (22) and (23), and the arrangement of the lock nuts (215), screw rod (214) and connector (211) in each union swivel, the lamp bracket structure (2) becomes adjustable angularly, and two parallel rods (24) form two independent circuits respectively protected from short-circuit. By means of the fastening of the bottom shaft (238) of the connector (231) of the lower union swivel (23) in the unitary, upstanding sleeve (41), the lamp bracket structure (2) is allowed to rotate on the stand (4) through an angle of 360°.

What is claimed is:

1. A desk lamp, including:

a lamp shade structure comprised of a lamp shade, a sleeve set in said lamp shade, an adjusting rod having a thread portion on its upper end, and a lamp socket, said sleeve comprising a boring bore for receiving said lamp socket, a first circular groove for the setting therein of the top thread portion of said adjusting rod, and a second circular groove having two small holes, said adjusting rod being to control the rotation of said lamp shade on said sleeve;

a lamp bracket structure comprised of an upper union swivel, an intermediate union swivel, a lower union swivel, two parallel rods, and an expansion spring, said upper, intermediate and lower union swivels being each comprised of a connector, two conductive rings, two retaining rings, a screw rod, and a pair of lock nuts permitting said two parallel rods to form two independent conductive circuits, said upper union swivel being connected to said lamp shade structure by means of two C-shaped retainers which have one ends fastened in the small holes of the sleeve of said lamp shade structure and the other ends secured to the connector of said upper union swivel, said lower union swivel being connected to a lamp stand by means of a shaft which is inserted in an unitary sleeve upstanding form said lamp stand permitting said lamp bracket to rotate on said lamp stand through an angle of 360°;

a pendulum backwardly connected to said intermediate union swivel through two branch rods, and comprised of two circular weights having stepped holes for the fastening therein of two insulator tubes, an insulator ring, a screw rod and two lock nuts, permitting said two circular weights to be insulated from each other.

* * * * *